US008286281B1

(12) United States Patent
Toothman

(10) Patent No.: US 8,286,281 B1
(45) Date of Patent: Oct. 16, 2012

(54) PERSONAL LIFTING AND SUSPENSION SYSTEM

(76) Inventor: Allen Toothman, Ravenswood, WV (US)

( * ) Notice: Subject to any disclaimer, the term of this patent is extended or adjusted under 35 U.S.C. 154(b) by 151 days.

(21) Appl. No.: 12/795,778

(22) Filed: Jun. 8, 2010

(51) Int. Cl.
*A61G 5/00* (2006.01)

(52) U.S. Cl. ..... 5/81.1 R; 5/83.1; 5/85.1; 248/166

(58) Field of Classification Search ..... 5/81.1 R, 5/83.1, 85.1; 75/81.1 R, 83.1, 85.1; 248/165, 248/166
See application file for complete search history.

(56) References Cited

U.S. PATENT DOCUMENTS

| | | | | |
|---|---|---|---|---|
| 1,214,104 | A | 1/1917 | Wingire | |
| 1,738,758 | A | 12/1929 | Cottman | |
| 1,878,785 | A | 9/1932 | Leavitt | |
| 2,516,553 | A | 7/1950 | Cole | |
| 3,520,514 | A * | 7/1970 | Evans | 248/168 |
| 3,765,630 | A | 10/1973 | Woolley | |
| 4,117,561 | A | 10/1978 | Zamotin | |
| 4,296,509 | A | 10/1981 | Simmons et al. | |
| 4,860,404 | A | 8/1989 | Flachs | |
| 5,802,633 | A | 9/1998 | Capaldi | |
| 5,809,591 | A | 9/1998 | Capaldi et al. | |
| 6,533,135 | B1 * | 3/2003 | Ford et al. | 5/85.1 |
| 6,637,610 | B1 * | 10/2003 | Cheeseboro | 5/83.1 |

* cited by examiner

*Primary Examiner* — Robert G Santos
*Assistant Examiner* — Brittany Wilson
(74) *Attorney, Agent, or Firm* — Kyle Fletcher

(57) ABSTRACT

The personal lifting and suspension system includes four adjustable legs that attach at a top end to a cap, which supports a lifting means and harness there under. The personal lifting and suspension system is used to lift and suspend a person or invalid. The legs can be secured to a working supporting position via a locking means. The legs extend diagonally down and outwardly from the cap, and are adjustable in length. A hoist rod rests upon a groove located in a top surface of the cap to support a hoist hook thereon. The personal lifting and suspension system is collapsible when not in use.

16 Claims, 5 Drawing Sheets

PERSONAL LIFTING AND SUSPENSION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hoisting systems, more specifically, a lifting and suspension system for personal use.

B. Discussion of the Prior Art

As a preliminary note, it should be stated that there is an ample amount of prior art that deals with lifting and suspension systems. As will be discussed immediately below, no prior art discloses a personal hoist consisting of four adjustable legs that unite at a top end to a cap, which suspends a lifting means and harness there under such that an end user is suspended under the cap, and wherein the four legs extend diagonally down and away from said cap.

The Zamotin Patent (U.S. Pat. No. 4,117,561) discloses a movable manually operated patient lift device. However, the collapsible frame.

The Leavitt Patent (U.S. Pat. No. 1,878,785) discloses an invalid lifter with a hand cranked lift mechanism for a body support sling. However, the invalid lifter is mobile includes a hand crank on the side of the frame, which is not suspended above the harness or include a collapsible frame of tubular construction.

The Simmons et al. Patent (U.S. Pat. No. 4,296,509) discloses a portable invalid lift with a tripod support structure. However, the invalid lift support uses a cross-beam that is supported by a pair of telescoping tripod legs as opposed to a hoisting system that uses a harness to lift a person that is suspended via a frame consisting of four collapsible legs.

The Cole Patent (U.S. Pat. No. 2,516,553) discloses an invalid handling apparatus that includes a hand cranked lifting mechanism with a body sling. However, the apparatus does not have a frame consisting of four collapsible legs of tubular construction that suspend a hand crank in connection with a harness.

The Cottman Patent (U.S. Pat. No. 1,738,758) discloses an apparatus for lifting and moving invalids. However, the apparatus is not supported by four adjustable legs of tubular construction, which suspend the lifting means and harness there under.

The Wingire Patent (U.S. Pat. No. 1,214,104) discloses a portable hoist. However, the portable hoist does not use collapsible legs of tubular construction which unite to support there under a lifting means and harness.

The Woolley Patent (U.S. Pat. No. 3,765,630) discloses a portable load supporting apparatus. However, the apparatus uses three collapsible legs as opposed to four, which unite at a cap to suspend a lifting means and harness there under.

Furthermore, the apparatus uses a plurality of rods and arms that interconnect amongst the legs.

The Capaldi et al. Patent (U.S. Pat. No. 5,809,591) discloses a patient lift system that involves a large frame and rails that extend across said frame to enable a harness to traverse within the boundary defined by said rails, as opposed to a hoist that simply hoists and does not provide lateral movement.

The Capaldi Patent (U.S. Pat. No. 5,802,633) discloses a portable patient lift assembly. However, the lift assembly does not have a collapsible frame of tubular construction.

The Flachs Patent (U.S. Pat. No. 4,860,404) discloses a portable multi-leg deer hoist. However, the hoist does not have a cap that unites four adjustable legs thereon, and of which have a lifting means and harness suspended under the cap.

While the above-described devices fulfill their respective and particular objects and requirements, they do not describe a personal hoist consisting of four adjustable legs that unite at a top end to a cap, which suspends a lifting means and harness there under such that an end user is suspended under the cap, and wherein the four legs extend diagonally down and away from said cap. In this regard, the personal lifting and suspension system departs from the conventional concepts and designs of the prior art.

SUMMARY OF THE INVENTION

The personal lifting and suspension system includes four adjustable legs that attach at a top end to a cap, which supports a lifting means and harness there under. The personal lifting and suspension system is used to lift and suspend a person or invalid. The legs can be secured to a working supporting position via a locking means. The legs extend diagonally down and outwardly from the cap, and are adjustable in length. A hoist rod rests upon a groove located in a top surface of the cap to support a hoist hook thereon. The personal lifting and suspension system is collapsible when not in use.

It is an object of the invention to provide a personal hoist system that includes adjustable legs that enable the overall elevational of the harness supported there under.

A further object of the invention is to provide a locking means that enables the adjustable legs to lock into a supporting state or unlock, retract in length, and rotate inwardly in an non-supporting state.

A further object of the invention is to provide a cap that supports a hoist rod via a groove located on the top surface of the cap.

A further object of the invention is to include a harness and lifting means that are suspended under the cap in order to provide a means of operation by an end user or an aid.

A further object of the invention is to include a personal lifting and suspension system that is collapsible when not in use.

These together with additional objects, features and advantages of the personal lifting and suspension system will be readily apparent to those of ordinary skill in the art upon reading the following detailed description of presently preferred, but nonetheless illustrative, embodiments of the personal lifting and suspension system when taken in conjunction with the accompanying drawings.

In this respect, before explaining the current embodiments of the personal lifting and suspension system in detail, it is to be understood that the personal lifting and suspension system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personal lifting and suspension system.

It is therefore important that the claims be regarded as including such equivalent construction insofar as they do not depart from the spirit and scope of the personal lifting and suspension system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
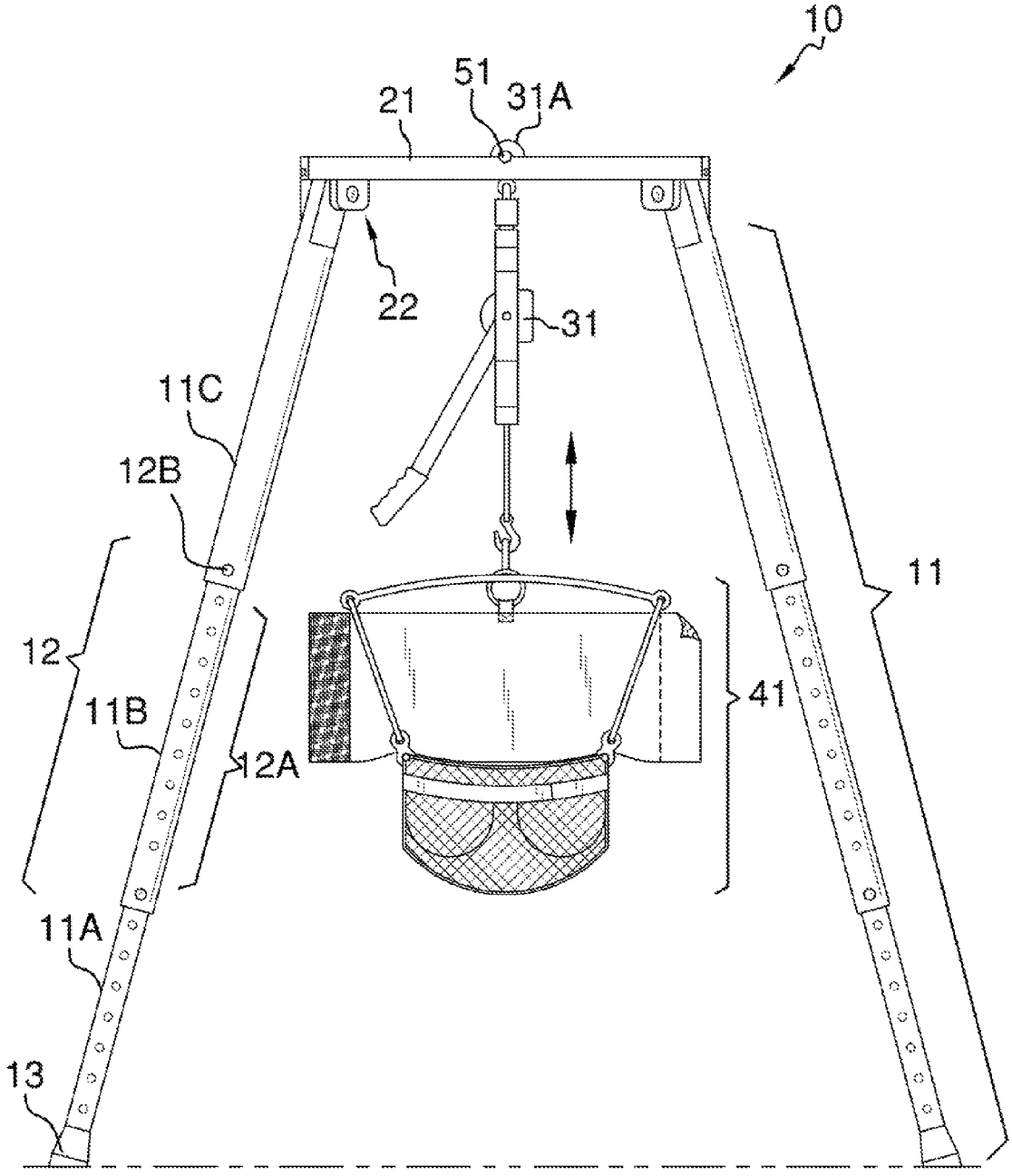
FIG. 1 illustrates a front view of the personal lifting and suspension system by itself and with a vertical arrow indicating vertical movement of the harness with respect to the lifting means, and of which depicts a vest wrap in an open state with a sewn-in ring attached to the lifting means, which is manually operated.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4B. A personal lifting and suspension system 10 (hereinafter invention) includes a plurality of legs 11, a cap 21, a lifting means 31, and a harness 41.

The plurality of legs 11 are extendable in length, and may be telescoping in design. The plurality of legs 11 are of tubular construction and made of a material comprising a metal, wood, plastic, or carbon fiber composite. The cap 21 is made of a material comprising a metal, plastic, wood, or carbon fiber composite.

Figure 4B:
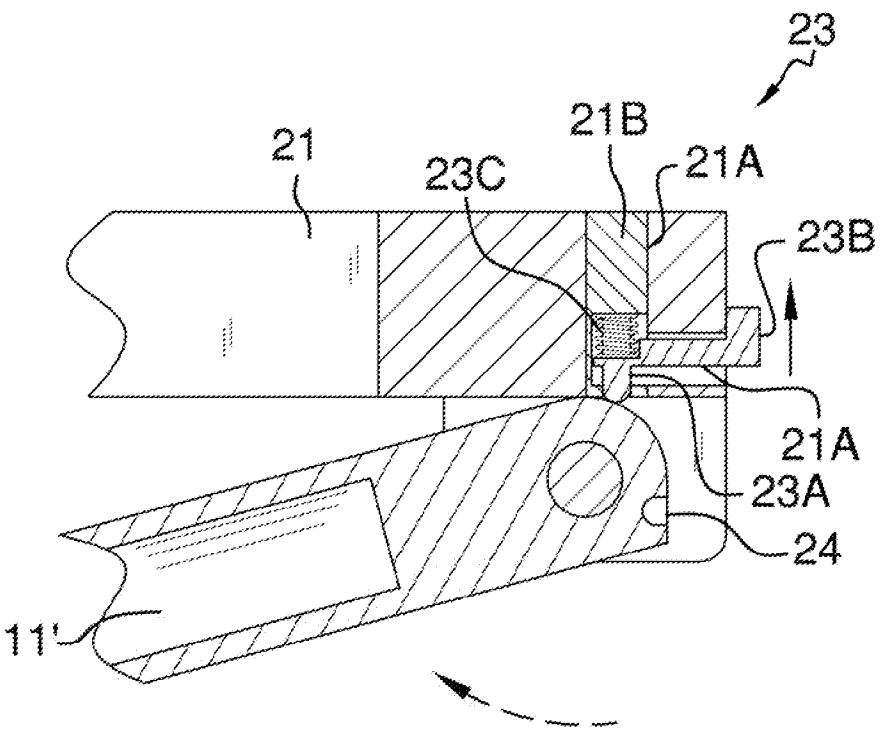
FIG. 4B illustrates a cross-sectional view of the personal lifting and suspension system along line 4-4 in FIG. 2 and further depicting rotation of and unlocking of the leg via an upward arrow and rotational arrow.
Figure 4A:
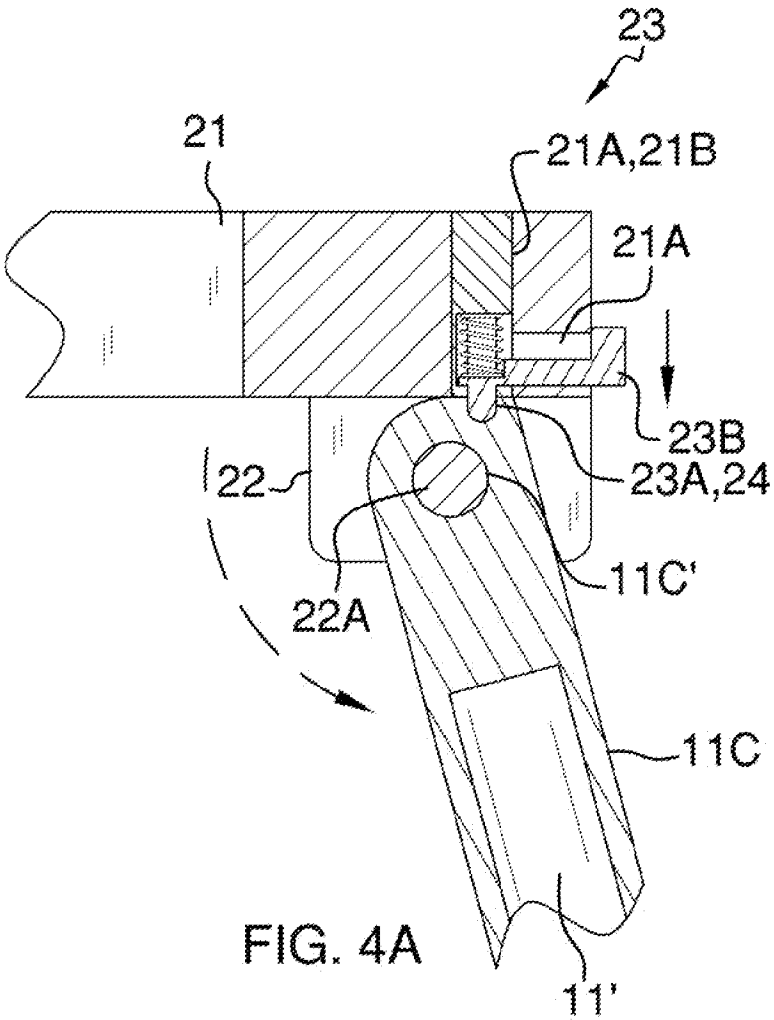
FIG. 4A illustrates a cross-sectional view of the personal lifting and suspension system along line 4-4 in FIG. 2 and further depicting the locking means integrated into the cap and one of the four legs, and with a downward arrow and a rotational arrow indicating rotation and locking of the leg via the locking means.

Each leg 11, as depicted, includes a bottom portion 11A, middle portion 11B, and top portion 11C. The bottom portion 11A can slide in out of the middle portion 11B; whereas the middle portion 11B can slide in and out of the top portion 11C. Referring to FIGS. 4A and 4B, a cavity 11" is located in the middle portion 11B and the top portion 11C, which enables the respective portion to slide in or out there of. The ability of one portion to slide in and out of another portion requires the use of a height adjusting means 12, which consists of a plurality of holes 12A and a spring-loaded push button 12B, which is well known in the art. The bottom portion 11A has a rubber foot 13 that provides traction to the ground. The inclusion of the bottom portion 11A, the middle portion 11B, and the top portion 11C insures that the overall length of the leg 11 can be adjusted to differing elevations, but also to collapse for storage when the invention 10 is no longer in use.

Each leg 11 attaches via a hinge 22 onto the cap 21 at a top of each leg 11, or at a top of the top portion 11C. The hinge 22 comprises a pin 22A and corresponding hole 11C' located on the leg 11 or top portion 11C.

A locking means 23 is integrated into both the cap 21 and the hinge 22. The locking means 23 insures that the leg 11, when in an extended and supporting state (see FIGS. 1, 2, 3, and 4A) will state locked. The locking means 23 includes a spring-loaded pin 23A that has a lock release button 23B integrated into the design. Both the spring-loaded pin 23A and the lock release button 23B are fitted into a chamber 21A having an elbow shape, which is located in the cap 21. A cap plug 21B is embedded into a top surface of the cap 21, and encloses the spring-loaded pin 23A within the chamber 21A. However, the cap plug 21B does not restrict vertical movement of the spring-loaded pin 23A within the chamber 21A. The spring-loaded pin 23A can traverse up or down with the chamber 21A, and is biased via a spring 23C.

Located at or near the top of the leg 11 or top portion 11C is a pin recess 24 that catches the spring-loaded pin 23A, when the leg 11 is rotated in a supporting state (see FIG. 4A). To unlock the leg 11, the lock release button 23B is lifted up, thereby disengaging the spring-loaded pin 23A with respect to the pin recess 24 (see FIG. 4B); and thus enabling the leg 11 to rotate inwardly with respect to the cap 21.

A hoist rod 51 is positioned and rests atop a rod groove 21A, which is integrated into a top surface of the cap 21. A hole 21B is located at a center of the cap 21. The hoist rod 51 lies across the hole 21B. A hoist hook 31A attaches onto the hoist rod 51 (see FIGS. 1-3) to suspend the lifting means 31 and the harness 41 from under the cap 21.

The lifting means 31 requires manual operation to raise or lower the harness 41 with respect to the cap 21. However, the lifting means 31 may involve an electric motor (see FIG. 1B) to operate, and is thus not manual. The location of the lifting means 31 enables operation from under the cap 21 by an end user (not shown) or another person that is not an end user (also not shown). The invention 10 is capable of lifting and suspending an end user from under the cap 21.

Figure 1A:
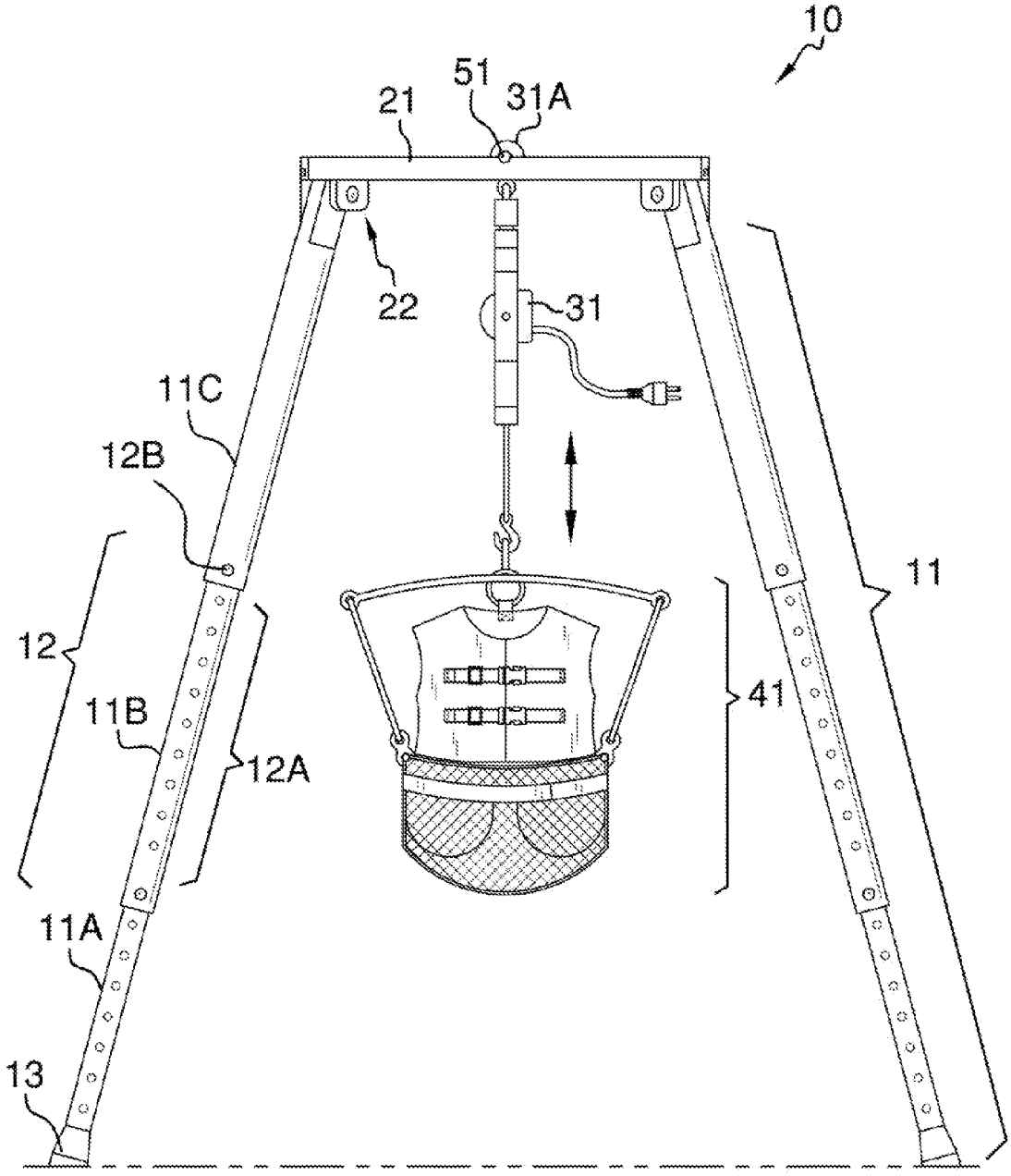
FIG. 1A illustrates a front view of the personal lifting and suspension system by itself and with a vertical arrow indicating vertical movement of the harness with respect to the lifting means, and wherein the lifting means involves an electrical motor, and wherein a vest is in a closed state with a sewn-in ring attached to the lifting means.
Figure 2:
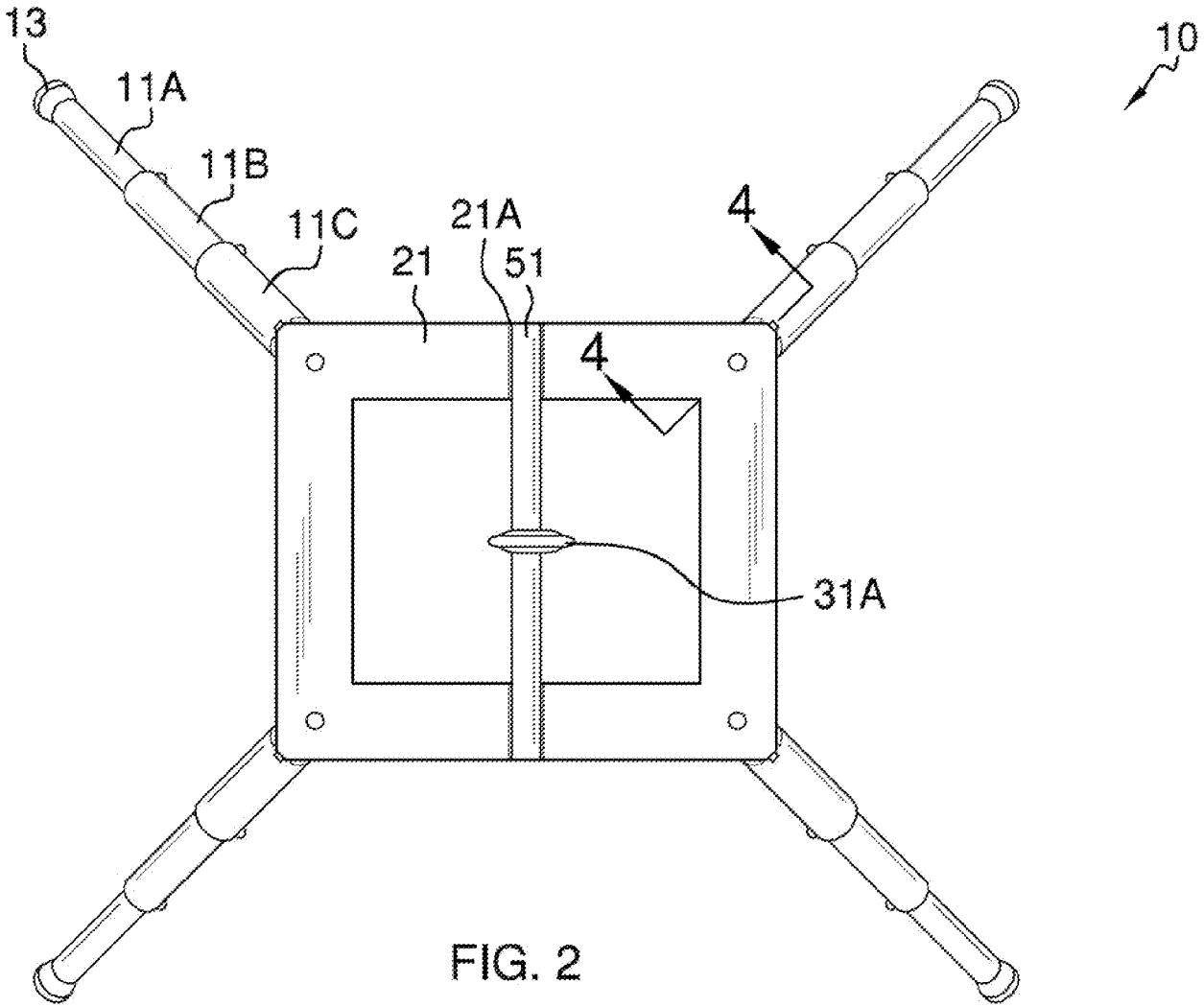
FIG. 2 illustrates a top'view of the personal lifting and suspension system by itself and depicting the hoist rod suspended across a top groove of the cap and with the hoist hook hanging thereon.
Figure 3:
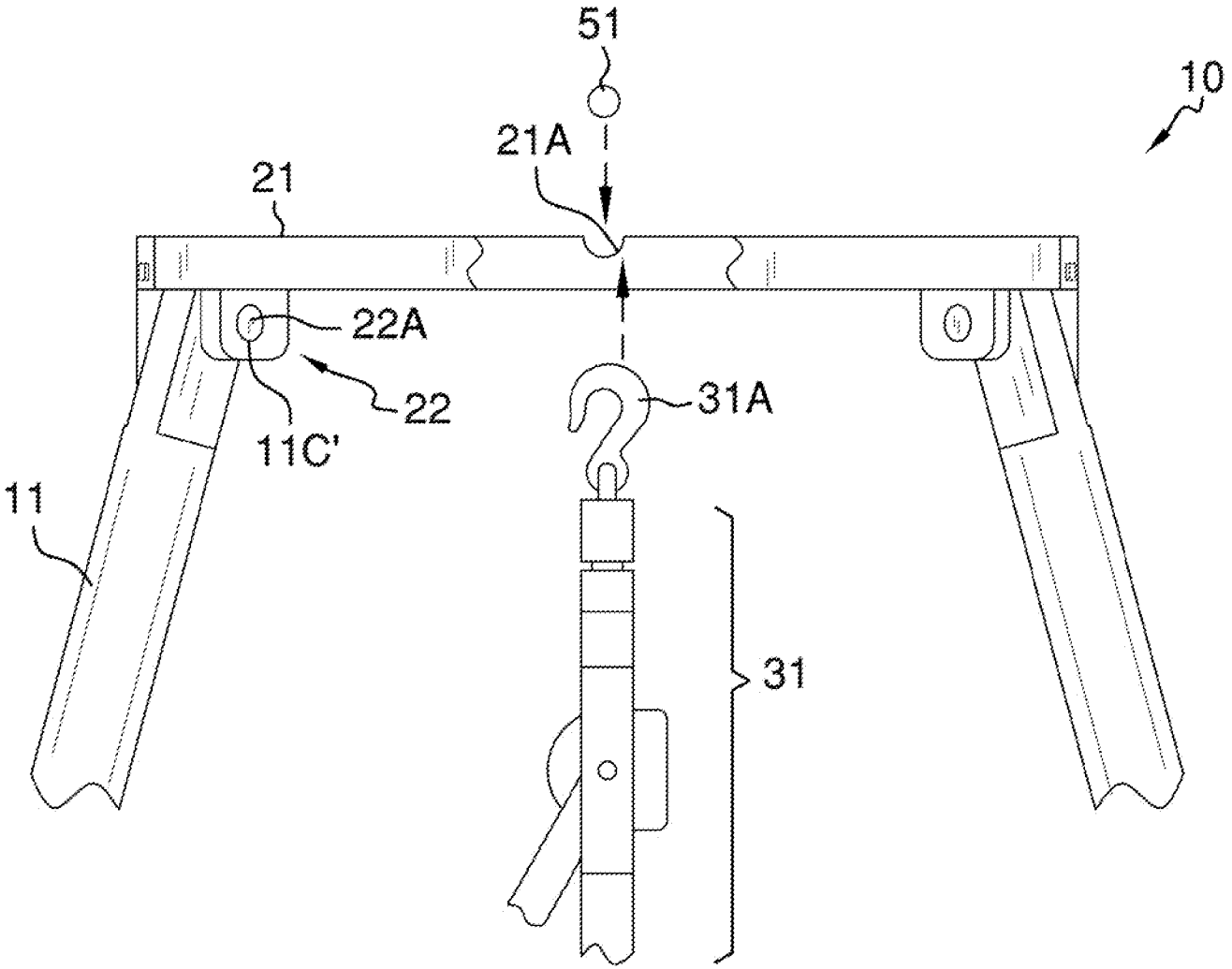
FIG. 3 illustrates a close up view of a side of the personal lifting and suspension system with a cutaway depicting the hoist rod located above the groove in the top of the cap via a downward arrow and the lifting means and hoist hook located there under with an upward arrow.

The harness 41 attaches to the lifting means 31 by a sewn-in ring 42. The harness 41 includes a vest 43 that is wrapped around a torso of an end user (not depicted) and secured via a securing means 44 comprising nylon hook and loop strips (see FIG. 1A) or adjustable straps (see FIG. 1B). The harness 41 also includes a bottom 45 through which an end user inserts his/her legs therein.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A personal lifting and suspension system comprising:
- a plurality of legs that each can be extended or collapsed;
- wherein the plurality of legs unite at a cap;
- wherein a lifting means and harness are suspended from under said cap and suspends an invalid there from;
- wherein the plurality of legs can rotate via a hinge in an inward state when not in use or in an outward supporting position;
- wherein a locking means is provided to secure the legs with respect to the cap;
- wherein a hoist rod rests onto a rod groove located on a top surface of the cap; and wherein the cap has a hole located about the center such that a hoist hook can attach onto the hoist rod, and thereby support the lifting means suspended there under said cap.

2. The personal lifting and suspension system as described in claim 1 wherein the legs consist of a bottom portion, middle portion, and top portion; and wherein a height adjusting means is provided and consists of a plurality of holes and a spring-loaded button being located on the bottom, middle, and top portions.

3. The personal lifting and suspension system as described in claim 1 wherein the legs are made of tubular construction having a cavity provided therein; and thus enables the bottom portion to slide in and out of the middle portion; and thus enables the middle portion to slide in and out of the top portion.

4. The personal lifting and suspension system as described in claim 3 wherein the legs are made of a material comprising a metal, plastic, wood, or carbon fiber composite.

5. The personal lifting and suspension system as described in claim 1 wherein the cap is made of a material comprising a metal, plastic, wood, or carbon fiber composite.

6. The personal lifting and suspension system as described in claim 1 wherein the locking means includes a spring-loaded pin that is integrated into a chamber located in the cap; and wherein the spring-loaded pin can lock the leg in a supporting state by a corresponding recess located at a top end of the leg.

7. The personal lifting and suspension system as described in claim 1 wherein the lifting means is either manually operated or includes a motor.

8. The personal lifting and suspension system as described in claim 1 wherein the harness includes a vest that wraps around the torso, and a bottom into which legs are inserted; wherein the vest is closed via securing means comprising nylon hook and loop strips or adjustable straps; and wherein the harness is attached to the lifting means via a sewn in ring.

9. A personal lifting and suspension system, further comprising:
- four legs that each can be extended or collapsed;
- wherein the legs unite at a four-cornered cap;
- wherein a lifting means and harness are suspended from under said cap, which suspends an invalid there from;
- wherein the legs can rotate via a hinge in an inward state when not in use or in an outward supporting position;
- wherein a locking means is provided to secure the legs with respect to the cap;
- wherein a hoist rod rests onto a rod groove located on a top surface of the cap; and wherein the cap has a hole located about the center such that a hoist hook can attach onto the hoist rod, and thereby support the lifting means suspended there under said cap.

10. The personal lifting and suspension system as described in claim 9 wherein the legs consist of a bottom portion, middle portion, and top portion; and wherein a height adjusting means is provided and consists of a plurality of holes and a spring-loaded button being located on the bottom, middle, and top portions.

11. The personal lifting and suspension system as described in claim 10 wherein the legs are made of tubular construction having a cavity provided therein; and thus enables the bottom portion to slide in and out of the middle portion; and thus enables the middle portion to slide in and out of the top portion.

12. The personal lifting and suspension system as described in claim 11 wherein the legs are made of a material comprising a metal, plastic, wood, or carbon fiber composite.

13. The personal lifting and suspension system as described in claim 9 wherein the cap is made of a material comprising a metal, plastic, wood, or carbon fiber composite.

14. The personal lifting and suspension system as described in claim 9 wherein the locking means includes a spring-loaded pin that is integrated into a chamber located in the cap; and wherein the spring-loaded pin can lock the leg in a supporting state by a corresponding recess located at a top end of the leg.

15. The personal lifting and suspension system as described in claim 9 wherein the lifting means is either manually operated or includes a motor.

16. The personal lifting and suspension system as described in claim 9 wherein the harness includes a vest that wraps around the torso, and a bottom into which legs are inserted; wherein the vest is closed via securing means comprising nylon hook and loop strips or adjustable straps; and wherein the harness is attached to the lifting means via a sewn in ring.

* * * * *